US006294225B1

(12) United States Patent
McCay et al.

(10) Patent No.: US 6,294,225 B1
(45) Date of Patent: Sep. 25, 2001

(54) METHOD FOR IMPROVING THE WEAR AND CORROSION RESISTANCE OF MATERIAL TRANSPORT TRAILER SURFACES

(75) Inventors: Mary Helen McCay; T. Dwayne McCay, both of Monteagle; John A. Hopkins; Narendra B. Dahotre, both of Tullahoma; Frederick A. Schwartz, Woodbury; John Brice Bible, South Pittsburg, all of TN (US)

(73) Assignee: The University of Tennessee Research Corporation, Knoxville, TN (US)

( * ) Notice: Subject to any disclaimer, the term of this patent is extended or adjusted under 35 U.S.C. 154(b) by 0 days.

(21) Appl. No.: 09/309,122

(22) Filed: May 10, 1999

(51) Int. Cl.[7] ..... B05D 3/06; B23K 26/00

(52) U.S. Cl. ..... 427/554; 427/597; 219/121.66; 219/121.85

(58) Field of Search ..... 427/554, 555, 427/556, 596, 597; 219/121.66, 121.85

(56) References Cited

U.S. PATENT DOCUMENTS

| | | |
|---|---|---|
| 3,705,758 | 12/1972 | Haskal . |
| 3,848,104 | 11/1974 | Locke . |
| 3,986,767 | 10/1976 | Rexer et al. . |
| 4,015,100 | 3/1977 | Gnanamuthu et al. . |

(List continued on next page.)

FOREIGN PATENT DOCUMENTS

| | | |
|---|---|---|
| 876870A1 | 4/1998 | (EP) . |
| 63-278692 | 11/1988 | (JP) . |
| 381082 | 4/1991 | (JP) . |
| 5285686 | 11/1993 | (JP) . |
| 1557193 | 4/1990 | (SU) . |
| 1743770 | 6/1992 | (SU) . |
| WO 95/21720 | 8/1995 | (WO) . |
| WO 97/47397 | 12/1997 | (WO) . |

OTHER PUBLICATIONS

Derwent Abstract of DE 4126351A to Fraunhofer Ges Foerderung, Feb. 1993.*

Abstract (source unknown) of JP401083676A "Wear Resistant AI Alloymenker" to Kanazawa et al, Mar. 29, 1989.*

Abstract (source unidentified) of JP403115531A "Production of Remelted Camshaft" to Yamamoto et al, May 16, 1991.*

Abstract (source unidentified) of JP 40311587A "Production of Remelted Cam Shaft" to Ouchi et al, May 16, 1991.*

ASM Handbook, vol. 6, Welding, Brazing and Soldering, 1993 no month.

Ayers, et al.; "A Laser Processing Technique for Improving the Wear Resistance of Metals," *Journal of Metals,* Aug. 1981, 19–23.

Belvaux, et al.; "A Method for Obtaining a Uniform Non–Gaussian Laser Illumination," *Optics Communications,* vol. 15, No. 2, Oct. 1975, 193–195.

Bett, et al.; "Binary phase zone–plate arrays for laser–beam spatial–intensity distribution conversion," *Applied Optics,* vol. 34, No. 20, Jul. 10, 1995, 4025–4036.

Bewsher, et al.; "Design of single–element laser–beam shape projectors," Applied *Optics,* vol. 35, No. 10, Apr. 1, 1996, 1654–1658.

(List continued on next page.)

*Primary Examiner*—Marianne Padgett
(74) *Attorney, Agent, or Firm*—Duane, Morris & Heckscher LLP

(57) ABSTRACT

This invention relates to a method of improving the corrosion and wear resistance of a transport trailer surface. More specifically the present invention relates to a method of laser alloying the surface of a transport trailer to enhance the corrosion and wear resistant properties of the surface.

12 Claims, 4 Drawing Sheets

U.S. PATENT DOCUMENTS

| | | | | |
|---|---|---|---|---|
| 4,017,708 | | 4/1977 | Engel et al. . | |
| 4,157,923 | | 6/1979 | Yen et al. . | |
| 4,212,900 | * | 7/1980 | Serlin | 427/597 |
| 4,218,494 | * | 8/1980 | Belmondo et al. | 427/596 |
| 4,322,601 | | 3/1982 | Serlin . | |
| 4,401,726 | * | 8/1983 | Gnanamuthu | 427/554 |
| 4,434,189 | | 2/1984 | Zaplatynsky . | |
| 4,475,027 | | 10/1984 | Pressley . | |
| 4,480,169 | | 10/1984 | Macken . | |
| 4,495,255 | | 1/1985 | Draper et al. . | |
| 4,535,218 | | 8/1985 | Krause et al. . | |
| 4,615,903 | * | 10/1986 | Miller | 427/554 |
| 4,617,070 | | 10/1986 | Amende et al. . | |
| 4,638,163 | | 1/1987 | Braunlich et al. . | |
| 4,644,127 | | 2/1987 | La Rocca . | |
| 4,720,312 | | 1/1988 | Fukuizumi et al. . | |
| 4,724,299 | | 2/1988 | Hammeke . | |
| 4,732,778 | * | 3/1988 | Kawasaki | 427/597 |
| 4,739,093 | * | 4/1988 | Mehta et al. | 427/597 |
| 4,746,540 | | 5/1988 | Kawasaki et al. . | |
| 4,750,947 | | 6/1988 | Yoshiwara et al. . | |
| 4,801,352 | | 1/1989 | Piwczyk . | |
| 4,832,982 | * | 5/1989 | Mori et al. | 427/597 |
| 4,839,518 | | 6/1989 | Braunlich et al. . | |
| 4,847,112 | | 7/1989 | Halleux . | |
| 4,898,650 | | 2/1990 | Wu et al. . | |
| 4,904,498 | | 2/1990 | Wu . | |
| 4,964,967 | | 10/1990 | Hashimoto et al. . | |
| 4,981,716 | | 1/1991 | Sundstrom . | |
| 4,998,005 | | 3/1991 | Rathi et al. . | |
| 5,059,013 | | 10/1991 | Jain . | |
| 5,095,386 | | 3/1992 | Scheibengraber . | |
| 5,124,993 | | 6/1992 | Braunlich et al. . | |
| 5,130,172 | | 7/1992 | Hicks et al. . | |
| 5,147,999 | | 9/1992 | Dekumbis et al. . | |
| 5,182,430 | * | 1/1993 | Lagain | 427/556 |
| 5,196,672 | | 3/1993 | Matsuyama et al. . | |
| 5,208,431 | | 5/1993 | Uchiyama et al. . | |
| 5,230,755 | | 7/1993 | Pierantoni et al. . | |
| 5,247,155 | | 9/1993 | Steen et al. . | |
| 5,257,274 | | 10/1993 | Barrett et al. . | |
| 5,265,114 | | 11/1993 | Sun et al. . | |
| 5,267,013 | | 11/1993 | Spence . | |
| 5,290,368 | | 3/1994 | Gavigan et al. . | |
| 5,308,431 | | 5/1994 | Maher et al. . | |
| 5,314,003 | | 5/1994 | Mackay . | |
| 5,319,195 | | 6/1994 | Jones et al. . | |
| 5,322,436 | | 6/1994 | Horng et al. . | |
| 5,331,466 | | 7/1994 | Van Saarloos . | |
| 5,352,538 | | 10/1994 | Takeda et al. . | |
| 5,387,292 | * | 2/1995 | Morishige et al. | 427/597 |
| 5,406,042 | | 4/1995 | Engelfriet et al. . | |
| 5,409,741 | | 4/1995 | Laude . | |
| 5,411,770 | | 5/1995 | Tsai et al. . | |
| 5,430,270 | | 7/1995 | Findlan et al. . | |
| 5,446,258 | | 8/1995 | Mordike . | |
| 5,449,536 | | 9/1995 | Funkhouser et al. . | |
| 5,466,906 | | 11/1995 | McCune, Jr. et al. . | |
| 5,484,980 | | 1/1996 | Pratt et al. . | |
| 5,486,677 | | 1/1996 | Maischner et al. . | |
| 5,491,317 | | 2/1996 | Pirl . | |
| 5,496,593 | * | 3/1996 | Tsai et al. | 427/556 |
| 5,514,849 | | 5/1996 | Findlan et al. . | |
| 5,530,221 | | 6/1996 | Benda et al. . | |
| 5,546,214 | | 8/1996 | Black et al. . | |
| 5,563,095 | | 10/1996 | Frey . | |
| 5,614,114 | | 3/1997 | Owen . | |
| 5,643,641 | | 7/1997 | Turchan et al. . | |
| 5,659,479 | | 8/1997 | Duley et al. . | |
| 5,759,641 | * | 6/1998 | Dimitrienko et al. | 427/597 |
| 5,874,011 | | 2/1999 | Ehrlich . | |
| 5,912,057 | * | 6/1999 | Nishimura et al. | 427/597 |
| 5,952,057 | * | 9/1999 | Parks | 427/597 |

OTHER PUBLICATIONS

Breinan, et al.; "Processing material with lasers," *Physics Today,* Nov. 1976, 44–50.

Bruno, et al.; "Laserbeam Shaping for Maximum Uniformity and Maximum Loss, A Novel Mirror Arrangement Folds the Lobes of a Multimode Laserbeam Back onto its Center," *Lasers & Applications,* Apr. 1987, 91–94.

Chen, et al.; "The Use of a Kaleidoscope to Obtain Uniform Flux Over a Large Area in a Solar or Arc Imaging Furnace," *Applied Optics,* vol. 2, No. 3, Mar. 1963, 265–571.

Christodoulou, et al.; "Laser surface melting of some alloy steels," *Metals Technology,* Jun. 1983, vol. 10, 215–222.

Cullis, et al.; "A device for laser beam diffusion and homogenisation," J. Phys.E:Sci. Instrum., vol. 12, 1979, 668–689 no month top of p. 689 illegible.

Dahotre, et al., "Development of microstructure in laser surface alloying of steel with chromium," *Journal of Materials Science,* vol. 25, 1990, 445–454 no month.

Dahotre, et al., "Laser Surface Melting and Alloying of Steel with Chromium," *Laser Material Processing III,* 1989, 3–19 no month.

Fernelius, et al.; "Design and Testing of a Refractive Laser Beam Homogenizer," Airforce Writing Aeronautical Laboratories Report, (AFWAL–TR–84–4042), Sep. 1984, 46 pages.

Galletti, et al.; "Transverse–mode selection in apertured super–Gaussian resonators: an experimental and numerical investigation for a pulsed $CO_2$ Doppler lidar transmitter," *Applied Optics,* vol. 36, No. 6, Feb. 20, 1997, 1269–1277.

Gori, et al.; "Shape–invariance range of a light beam," *Optics Letters,* vol. 21, No. 16, Aug. 15, 1996, 1205–1207.

Grojean, et al.; "Production of flat top beam profiles for high energy lasers," Rev. Sci. Instrum. 51(3), Mar. 1980, 375–376.

Hella, "Material Processing with High Power Lasers," *Optical Engineering,* vol. 17, No. 3, May–Jun. 1978, 198–201.

Ignatiev, et al.; "Real–time pyrometry in laser machining," *Measurement and Science Technology,* vol. 5, No. 5, 563–573 1994—no month 1st column, ever other page partly illegable.

"Laser Removing of Lead–Based Paint" Illinois Department of Transportation, Jun. 1992, 26 pages J. Janssen.

Jones et al.; "Laser–beam analysis pinpoints critical parameters," *Laser Focus World,* Jan. 1993, 123–130.

Khanna, et al.; "The Effect of Stainless Steel Plasma Coating and Laser Treatment on the Oxidation Resistance of Mild Steel," *Corrosion Science,* vol. 33, No. 6, 1992, 949–958 no month.

Lugscheider, et al.; "A Comparison of the Properties of Coatings Produced by Laser Cladding and Conventional Methods," *Surface Modification Technologies V,* The Institute of Materials, 1992, 383–400 no month.

Manna, et al.; "The One–dimensional Heat Transfer Model for Laser Surface Alloying of Chromium on Copper Substrate," Department of Metallurgical & Materials Engineering, Indian Institute of Technology, vol. 86, N. 5, May 1995, 362–364.

Mazille, et al.; "Surface Alloying of Mild Steel by Laser Melting of Nickel and Nickel/Chromium Precoatings," *Materials Performance Maintenance,* Aug. 1991, 71–83.

Molian; "Characterization of Fusion Zone Defects in Laser Surface Alloying Applications," *Scripta Metallurgica,* vol. 17, 1983, 1311–1314 no month.

Molian; "Effect of Fusion Zone Shape on the Composition Uniformity of Laser Surface Alloyed Iron," *Scripta Metallurgica,* vol. 16, 1982, 65–68 no month.

Molian; Structure and hardness of laser–processed Fe–O.2%C–5%Cr and Fe–0.2%C–10%Cr alloys; *Journal of Materials Science,* vol. 20, 1985, 2903–2912 no month.

"Line–Focussing Optics for Multiple–Pass Laser Welding," NASA Tech Briefs MFS–29976, date unknown.

"Cylindrical Lenses," *Newport Technical Guide,,* date unknown, N–68.

"Fused Silica Cylindrical Lenses," *Newport Technical Guide,,* date unknown, N–68.

Oswald, et al.; "Measurement and modeling of primary beam shape in an ion microprobe mass analyser," IOP Publishing Ltd., 1990, 255–259 no month.

Renaud, et al., "Surface Alloying of Mild Steel by Laser Melting of an Electroless Nickel Deposit Containing Chromium Carbides," *Materials & Manufacturing Processes,* 6(2), 1991 no month, but is a reprint from a Nov. 1990 publication 315–330.

Smurov, et al.; "Peculiarities of pulse laser alloying: Influence of a spatial distribution of the beam," J. Appl. Phys. 71(7), Apr. 1, 1992, 3147–3158.

"Spawr Integrator," Spawr Optical Research, Inc., Data Sheet No. 512, Jun. 1986.

Veldkamp, et al.; "Beam profile shaping for laser radars that use detector arrays," *Applied Optics,* vol. 21, No. 2, Jan. 15, 1982, 345–358.

Veldkamp; "Laser Beam Profile Shaping with Binary Diffraction Gratings," *Optics communications,* vol. 38, No. 5,6, Sep. 1, 1981, 381–386.

Veldkamp; barely readable "Laser beam profile shpaing with interlaced binary diffraction gratings," *Applied Optics,* vol. 21, No. 17, Sep. 1, 1982, 3209–3212.

Veldkamp; "Technique for generating focal–plane flattop laser–beam profiles," Rev. Sci. Instru., vol. 53, No. 3, Mar. 1982, 294–297.

Walker, et al.; "Laser surface alloying of iron and 1C–1•4Cr steel with carbon," *Metals Technology,* vol. 11, Sep. 1984, 5 pages.

Walker, et al.; "The laser surface–alloying of iron with carbon," Journal of Material Science vol. 20, 1985, 989–995 no month.

Wei, et al.; "Investigation of High–Intensity Beam Characteristics on Welding Cavity Shape and Temperature Distribution," Journal of Heat Transfer, vol. 112, Feb. 1990, 163–169.

Charschan, "Lasers in industry," *Laser Processing Fundamentals,* (Van Nostrand Reinhold Company), Chapter 3, Sec. 3–1, 139–145. No date given, but predates 11/79.

Fernelius, et al; "Calculations Used in the Design of a Refractive Laser Beam Homogenizer," Airforce Writing Aeronautical Laboratories Report, (AFWAL–TR–84–4047), Aug. 1984, 18 pages (11 pages & i–Vii +cover sheet).

Jain, et al.; "Laser Induced Surface Alloy Formation and Diffusion of Antimony in Aluminum," *Nuclear Instruments and Method,* vol. 168, 275–282, 1980 no month.

Molian; "Estimation of cooling rates in laser surface alloying processes," Journal of Materials Science Letters, vol. 4, 1985, 265–267 no month.

"High Power CW Nd:YAG Laser Transformation Hardening," Hobart Laser Products, 2 pages no date or author.

* cited by examiner

METHOD FOR IMPROVING THE WEAR AND CORROSION RESISTANCE OF MATERIAL TRANSPORT TRAILER SURFACES

BACKGROUND OF THE INVENTION

1. Field of the Invention

This invention relates to a method of improving the corrosion and wear resistance of a transport trailer surface. More specifically the present invention relates to a method of laser alloying the surface of a transport trailer to enhance the corrosion and wear resistant properties of the surface.

2. Description of the Prior Art

Transport trailer surfaces are used to transport materials that are abrasive and/or corrosive. In many applications materials having abrasive properties, such as gravel or larger rocks, are dumped into, or slid off of, transport trailer surfaces resulting in surface wear and abrasion. Prior art transport trailer surfaces often have short lives as a result of the abrasive and corrosive forces to which they are exposed.

SUMMARY OF THE INVENTION

The present invention is directed toward a method or process for improving the corrosion and wear resistance of a material transport trailer surface. The present invention comprises applying a precursor layer comprising metallic or ceramic powders to a material transport trailer surface. The precursor layer has a thickness in the range of 50–150 microns.

The present invention further comprises irradiating the surface of the trailer with a laser at a sufficient energy level and for a sufficient time to melt a portion of the surface while the surface is moving relative to the laser beam.

DESCRIPTION OF THE PREFERRED EMBODIMENTS

Figure 1A:
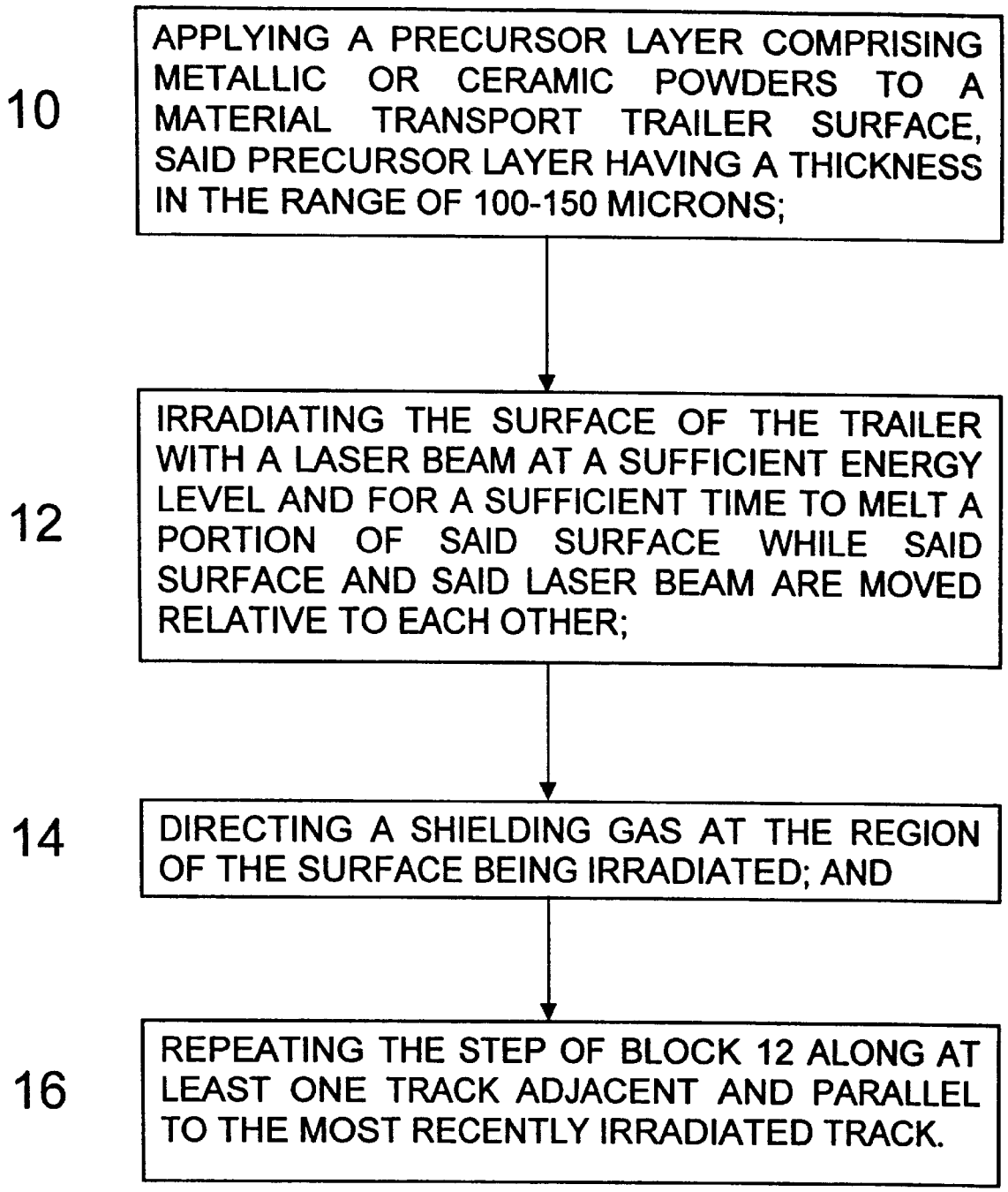
FIG. 1A is a block diagram depicting a first method of the present invention.
Figure 2:
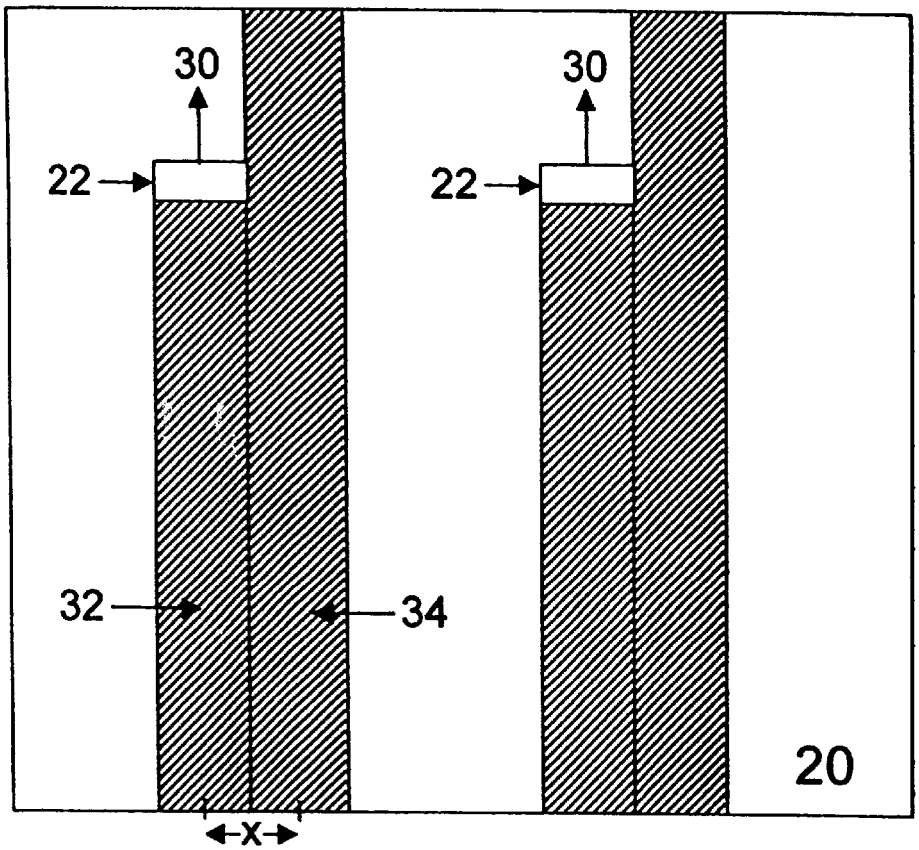
FIG. 2 is a top view of a transport trailer surface being processed by a method of the present invention.

The present invention comprises applying a precursor layer comprising metallic or ceramic powders to a material transport trailer surface, as shown in Block 10 of FIG. 1A and in FIG. 2. The precursor layer has a thickness in the range of 50–150 microns.

Figure 1B:
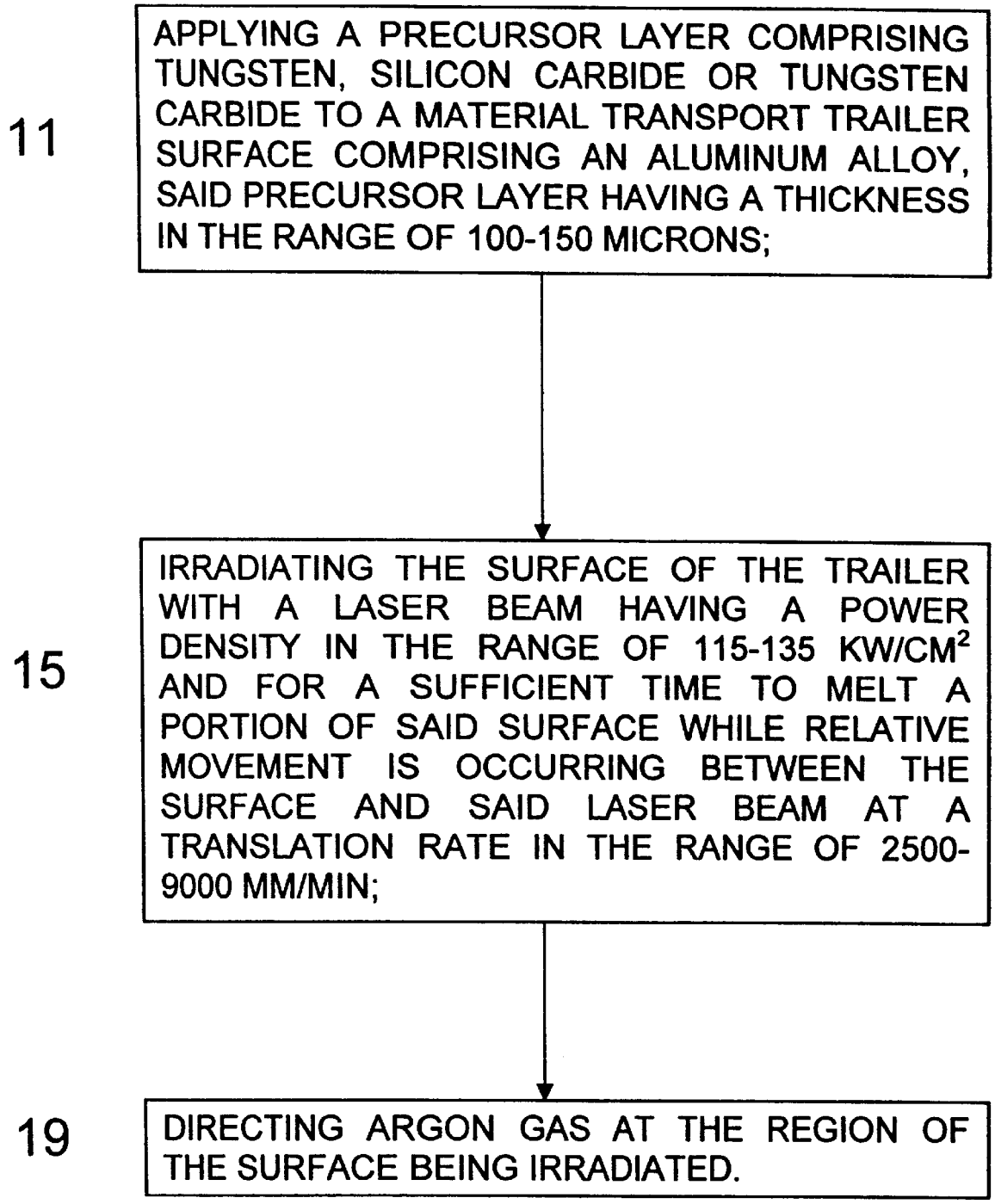
FIG. 1B is a block diagram depicting a second method of the present invention.

In one embodiment of the present invention, wherein the trailer surface comprises an aluminum alloy, the powder within the precursor, comprises tungsten or silicon carbide, as shown in Block 11 of FIG. 1B. In another preferred embodiment, wherein the trailer surface comprises steel, the powder within the precursor, comprises chromium and nickel, as shown in Block 13 of FIG. 1C.

The present invention further comprises irradiating the surface of a trailer 20 with a laser beam 22 at a sufficient energy level and for a sufficient time to melt the portion of the trailer surface while the surface is moving relative to the laser beam, as shown in Block 12 of FIG. 1A. In a preferred embodiment wherein the trailer surface comprises an aluminum alloy, the irradiating uses a laser having a power density in the range of 115–135 kilowatts/cm$^2$ as shown in Block 15 of FIG. 1B. In another preferred embodiment, the irradiating is performed at a power density of 125 kilowatts/cm$^2$.

In another preferred embodiment, the surface and the laser beam are moved relative to each other at a translation rate in the range of 2,500–9,000 millimeters per minute as shown in Block 15 of FIG. 1B. Such relative movement may be accomplished by moving the laser beam relative to a stationary surface, moving the surface relative to a stationary laser beam, or moving both the surface and the laser beam at different speeds and/or in different directions.

Figure 3:
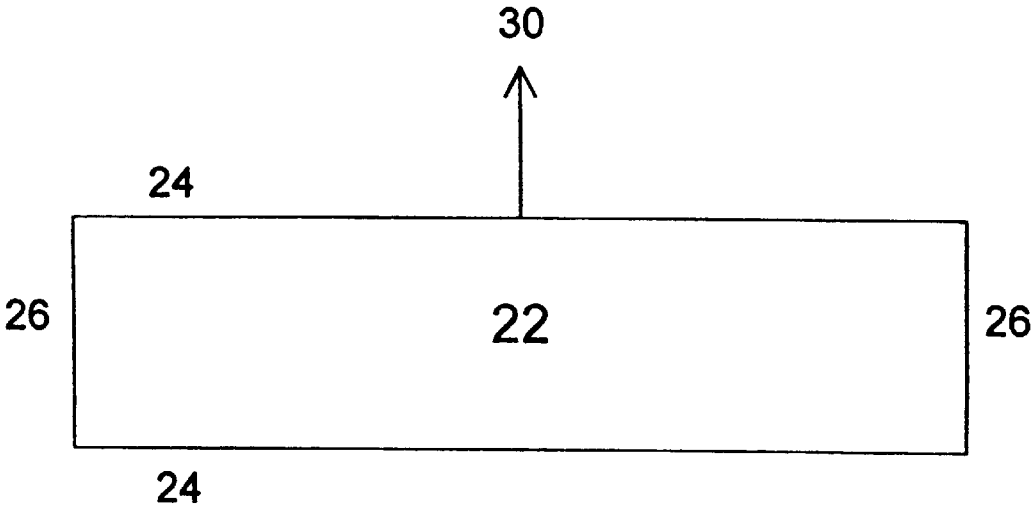
FIG. 3 is an enlarged top view of the laser beam cross sectional area on the transport trailer surface when practicing the method of the present invention.

In one preferred embodiment, the irradiating is performed with a laser beam 22 having a rectangular cross sectional area, as shown in FIG. 3. In another preferred embodiment, the longer sides 24 of said rectangular cross sectional area are perpendicular to the translation axis 30 of the laser beam relative to the surface, as shown in FIGS. 2 and 3.

In another preferred embodiment, the longer sides of the rectangular cross sectional area 24 of the laser beam have a length of at least 2.8 millimeters. In another preferred embodiment, the shorter sides 26 of the rectangular cross sectional area of the laser beam have a length of at least 0.4 millimeters. A rectangular beam profile having the dimensions described above can be achieved by aligning a spherical lens closest to the beam, a second cylindrical lens closest to the substrate and a first cylindrical lens between the spherical lens and the second cylindrical lens. The spherical lens should have a focal length of 152.4 millimeters. The first cylindrical lens should have a focal length of 203.2 millimeters. The second cylindrical lens should have a focal length of 152.4 millimeters. The spherical lens and the first cylindrical lens should be spaced apart by five millimeters. The first cylindrical lens and second cylindrical lens should be spaced apart by 25 millimeters.

In a preferred embodiment, the laser beam is moved along a linear path or track 32 relative to the surface, as shown in FIG. 2. In a preferred embodiment, the track index, x, is less than or equal to the width of the laser beam, as shown in FIG. 2. The term "track index", as used herein, refers to the distance between center lines of adjacent tracks.

In another preferred embodiment, the method of the present invention further comprises repeating the irradiating along at least one track 34 adjacent and parallel to the most recently irradiated track, as shown in Block 16 of FIG. 1A and in FIG. 2. In another preferred embodiment, the irradiating uses at least two laser beams simultaneously, as shown in FIG. 2.

Figure 1C:
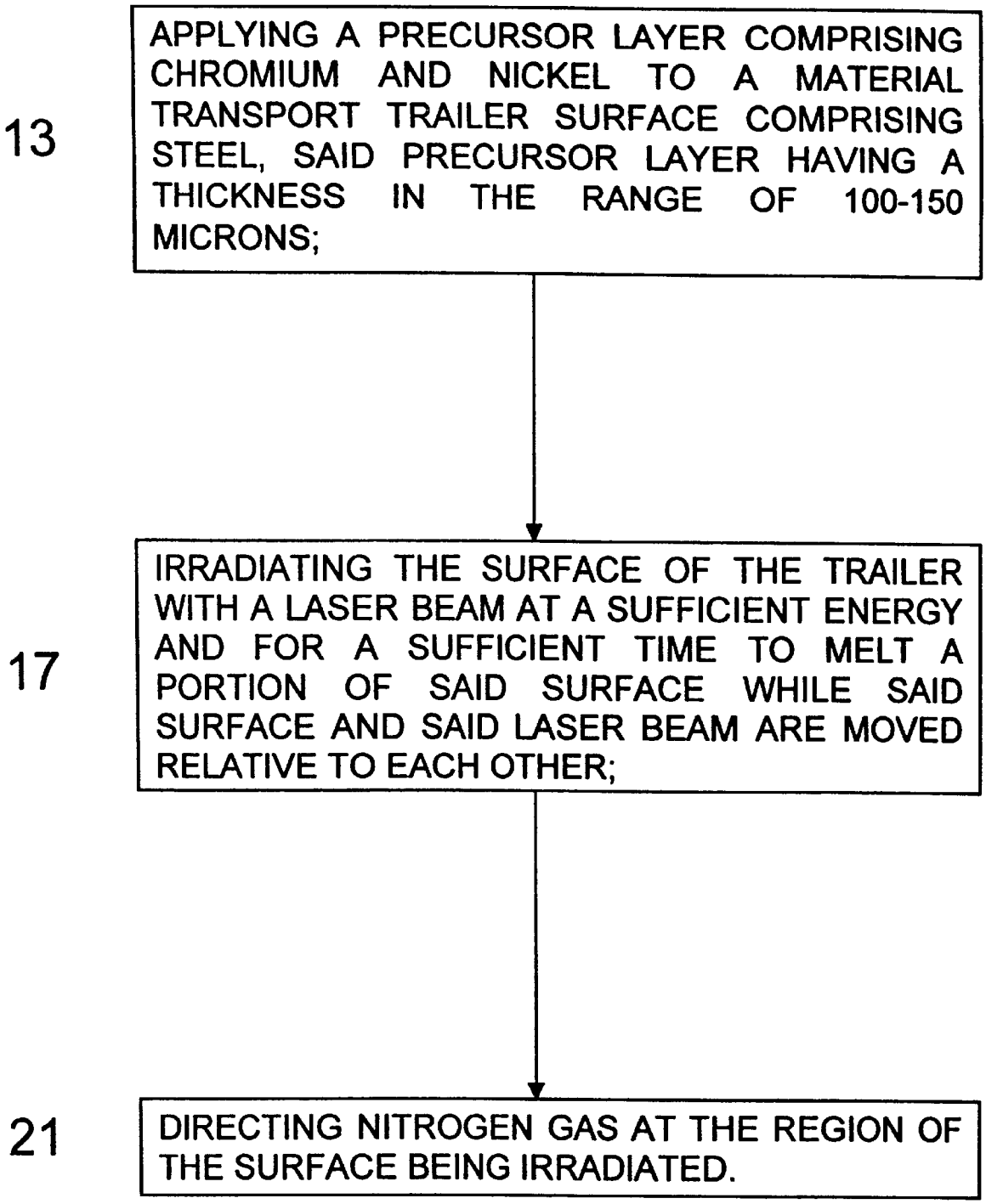
FIG. 1C is a block diagram depicting a third method of the present invention.

In a preferred embodiment, the present invention comprises directing a shielding gas at the region of the surface being irradiated, as shown in Block 14 of FIG. 1A In a preferred embodiment, the shielding gas is nitrogen as shown in Block 21 of FIG. 1C, or argon as shown in Block 19 of FIG. 1B.

The foregoing disclosure and description of the invention are illustrative and explanatory. Various changes in the size, shape, and materials, as well as in the details of the illustrative construction may be made without departing from the spirit of the invention.

What is claimed is:

1. A method for laser alloying a metallic material transport trailer surface comprising:

a. applying a precursor layer comprising metallic or ceramic powders to said material transport trailer surface, said precursor layer having a thickness in a range of 50–150 microns; and b. irradiating said surface with a laser beam having a rectangular cross sectional area at a sufficient energy level and for a sufficient time to melt a portion of said surface while said surface and said laser beam are moved relative to each other along a linear tract at a translation rate in the range of 2,500–9,000 millimeters per minute and wherein said laser beam has a width.

2. The method of claim 1, wherein said surface comprises aluminum and said irradiating uses a laser having a power density of in a range of 115–135 kilowatts/$cm^2$.

3. The method of claim 1, wherein said rectangular cross sectional area comprises two opposing longer sides that are perpendicular to the translation axis of said laser beam relative to said surface.

4. The method of claim 3, wherein said longer sides of said rectangular cross sectional area have a length of at least 2.8 millimeters.

5. The method of claim 4, wherein said shorter sides of said rectangular cross sectional area have a length of at least 0.4 millimeters.

6. The method of claim 1, wherein said laser beam is moved along a linear path relative to said surface.

7. The method of claim 1, wherein said irradiating uses at least two laser beams simultaneously.

8. The method of claim 1, further comprising directing a shielding gas at said surface while it is being irradiated.

9. A method for a metallic material transport trailer surface comprising:

a. applying a precursor layer comprising metallic or ceramic powders to said material transport trailer surface, said precursor layer having a thickness in a range of 50–150 microns;

b. irradiating said surface with a laser beam having a rectangular cross sectional area at a sufficient energy level and for a sufficient time to melt a portion of said surface while said surface and said laser beam are moved relative to each other along a linear tract at a translation rate in the range of 2,500–9,000 millimeters per minute; and c. directing a shielding gas at said surface while it is being irradiated.

10. The method of claim 9, wherein said rectangular cross sectional area comprises two longer sides, each of said longer sides having a length of at least 2.8 millimeters and two shorter sides, each of said shorter sides having a length of at least 0.4 millimeters.

11. The method of claim 9, wherein said trailer surface comprises an aluminum alloy and said powder comprises tungsten, silicon carbide or tungsten carbide.

12. The method of claim 9, wherein said trailer surface comprises steel and said powder comprises chromium and nickel.

* * * * *